United States Patent [19]

Wilson

[11] 4,240,478

[45] Dec. 23, 1980

[54] COMPACT HAMMER WITH RECESSED FACE AND NOTCHED CLAW

[76] Inventor: James F. Wilson, Rte. 1 Box 199, Dittmer, Mo. 63023

[21] Appl. No.: 6,852

[22] Filed: Jan. 26, 1979

[51] Int. Cl.[3] ..... B25C 1/00

[52] U.S. Cl. ..... 145/29 R; 145/29 D

[58] Field of Search ..... 145/29 R, 29 B, 29 D, 145/30 R; 254/26 R

[56] References Cited

U.S. PATENT DOCUMENTS

| | | | |
|---|---|---|---|
| 281,217 | 7/1883 | Wiedmann | 145/29 R |
| 1,262,515 | 4/1918 | Kingsley | 145/29 R |
| 1,737,647 | 12/1929 | Cummings | 145/29 D |

FOREIGN PATENT DOCUMENTS

| | | | |
|---|---|---|---|
| 2274407 | 1/1976 | France | 145/29 R |
| 8698 | 1/1900 | Norway | 254/26 |
| 10309 | 8/1886 | United Kingdom | 145/29 R |

*Primary Examiner*—Othell M. Simpson
*Assistant Examiner*—J. T. Zatarga
*Attorney, Agent, or Firm*—Rogers, Eilers & Howell

[57] ABSTRACT

A hammer has a head having a recessed face. The recess in one modification is formed by having four isosceles triangular slanted sections extending inward from the outer edge of the face. In another modification the face has a curved recess. The hammer head has flat exterior side surfaces and the head is positional close to the center line of the handle. The hammer claw has a rectangular notch between the two claw fingers, making the claw especially adaptable for disengaging tie-wire loops or bolt ends with slots in their outer ends. The hammer is useful for driving objects such as nails, pins, and wedges, and is especially useful in work involving concrete forms.

7 Claims, 6 Drawing Figures

COMPACT HAMMER WITH RECESSED FACE AND NOTCHED CLAW

BACKGROUND AND FIELD OF THE INVENTION

This present invention is concerned with hammers, and more particularly hammers used in the setting and stripping of concrete forms, especially Symons concrete forms and modular concrete forms. In the prior art there have been difficulties with hammers slipping away from the object which they strike against, such as a nail, rod or wedge. Prior art hammers have had heads with flat striking faces and these striking faces do not direct force of impact towards the center of the hammer to prevent sliding of the hammer face away from the object struck. After a period of time prior art hammers wear away due to striking at points about the center of the hammer head face so that the face assumes a somewhat convex outer surface which produces a greater tendency for slippage.

Prior art hammers have had claws which have two fingers separated by a v-shaped slot. In using such claw fingers to break concrete tie-wire loops there is a tendency for the loop to become wedged between the two fingers. This is because the tapered nature of the groove allows the loop to slide deeply within the v-shaped slot. With prior art claws it has been difficult to insert a claw finger into a bolt slot or the like to turn the bolt because the other finger is too close and prevents such insertion.

Also, in the prior art, it has been necessary to use a crow bar to pry pins away from the forms so that a prior art hammer can be used to strike the pin to disengage it. This keeps both hands occupied.

Prior art hammers have also had heads that are positioned too great a length away from the hammer handle, causing difficulty in manipulating the hammer in close spaces.

SUMMARY OF THE INVENTION

The present invention overcomes difficulties of the prior art. The present hammer has a head with a recessed striking face. The face is square and the sides of the head are flat. In one modification the recess is provided by four isosceles triangular slanted surface sections which extend inward from the outer edges of the hammer. In another modification the recess is curved. The recessed surface causes objects struck to be directed towards the center of the hammer face which provides for greater driving force, and also prevents the struck object and hammer from sliding away from each other before the full driving force of the hammer has been utilized. This is especially useful when the hammer must be swung near a flat surface, such as a concrete form board, against a wedge in which case it is sometimes not possible to make contact with the face center. Thus even though the face strikes an object at a point off-center of the head face, driving contact with the face can be maintained.

With the present hammer it is unnecessary to use a crowbar to pry pins away from concrete forms so that they can be struck by the hammer. The present hammer is shaped to allow pins extending flush against surfaces to be struck and driven without sliding away from contact.

The present hammer has a rectangular notch formed between the two claw finger ends forming prongs at the finger ends. This allows either of the finger prongs to be inserted easily into the looped end of a concrete snap tie to twist the wire and break it and then pull it apart. Because of the rectangular slot, the problem of the snap tie loop wedging between the claw fingers is alleviated. The finger prongs are also sufficiently separated by the rectangular notch so that either one of the prongs may be inserted in the slot of a bolt of certain sizes to turn the bolt without insertion interference from the other prong. The claw notch also allows the finger prongs to be used to be inserted in other slots to turn or twist objects.

The present hammer has its head positioned very close to the center line of the handle thus making the hammer compact. This enables easier manipulation of the head in close places than with prior art hammers. Having the head closer to the handle also increases control over the swinging of the hammer. The head is also spread somewhat wider from the intermediate portion of the hammer allowing more efficient use of the head material for striking force.

DESCRIPTION OF THE PREFERRED EMBODIMENT

Figures 1, 5:
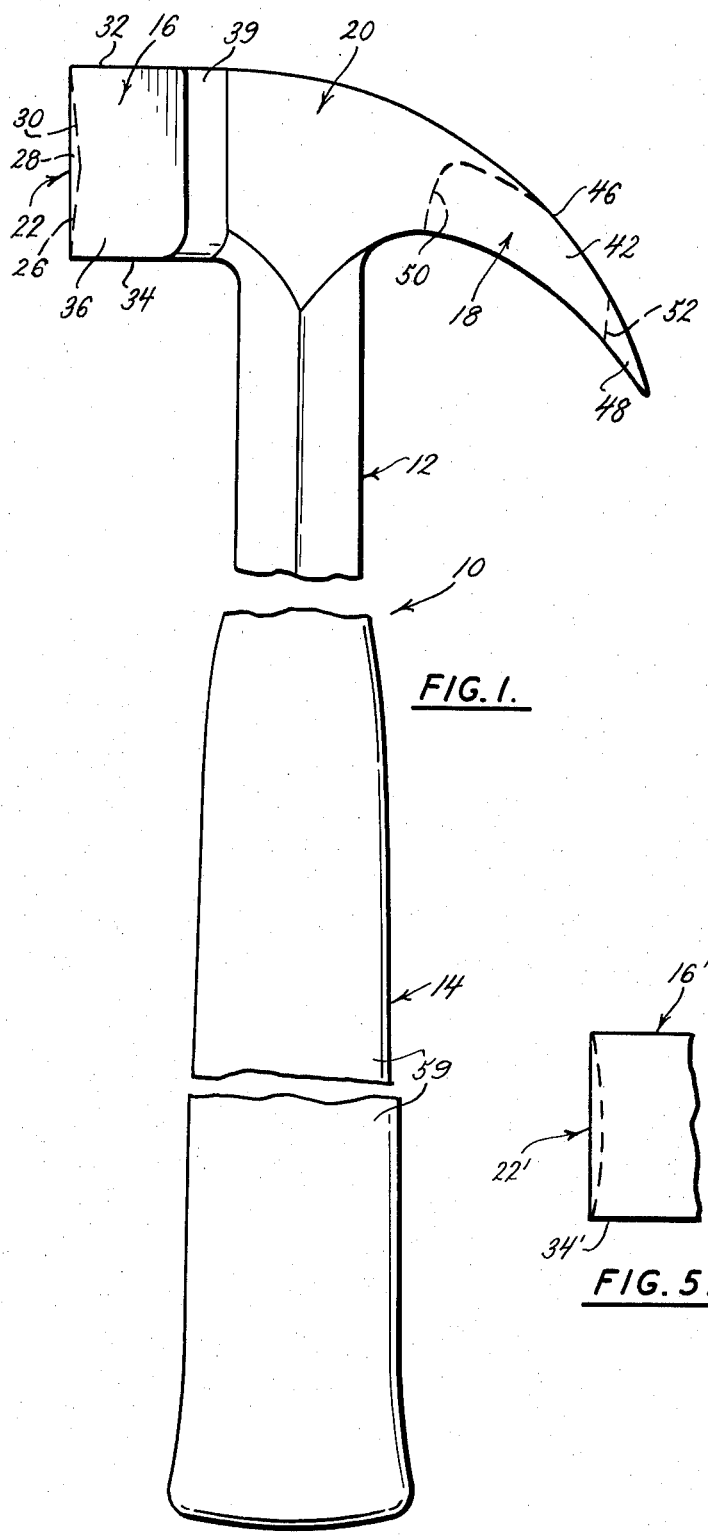
FIG. 1 is a side view of the hammer, showing the head and claw, with dashed lines showing the angular recess in exaggerated form for clarity, the actual angle slant being about 2 degrees, the handle being shown broken.
FIG. 5 is a side view of a portion of a modified hammer head showing a modified curved recess face, a top plan view of this modified portion would appear the same.

The hammer 10, as seen in the drawings, has a handle rod section 12 having an enlarged lower end gripping portion 14, an upper end head portion 16 and claw portion 18, with an intermediate portion 20 between the head 16 and the claw 18.

Figure 2:
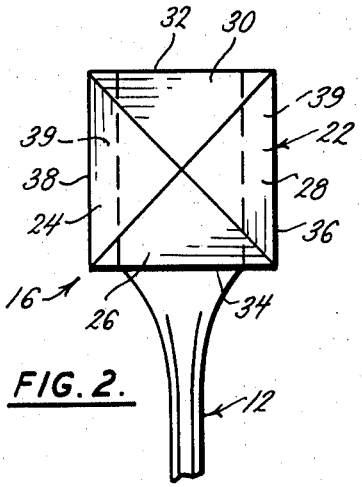
FIG. 2 is a plan view of the hammer head face showing the isosceles triangular slanted surface sections, the handle shown broken, and not showing the claw.

Head 16 has a square face 22 (at the left end of the head in FIG. 1) for use as a striking surface to strike nails, wedges, rods, and other objects to be driven. The face 22 is recessed inward from left to right, as seen in FIG. 1, towards the intermediate portion 20. The face 22, as seen in FIG. 2, has four isosceles triangular sections 24, 26,28, and 30, each having its base, (about $1\frac{1}{4}$ inch, 3.175 cm., in length) as an outer edge of the square face 22, and having its other equal sides formed by diagonal lines extending from the corners of the square face 22. The triangular sections 24,26, 28 and 30 slope inward at any angle of approximately 2 degrees from the outer straight edges of the face, with FIG. 2 showing the 2 degree slope in exaggerated form for clarity.

The recessed surface 22 prevents the object struck, such as a wedge or a nail, from sliding off the face, and directs the struck object towards the center of the face.

Extending rearwardly from the perimeter edges of the face, the head 16 has four flat outer side surfaces including a top surface 32, bottom surface 34, and sides surfaces 36 and 38, all extending rearwardly about ¾ in (1.905 cm.), with the lower corners of the head slightly beveled. These flat surfaces enable the hammer to be moved against the flat side of a board or angle iron, such as those used in concrete forms, so that more of the face and driving force can be utilized in such situations.

From the rear of the side surfaces 36 and 38, at 39, the hammer tapers towards the center to reduce the width of the hammer, the depth of the slanted portion being about ¼ in. or 0.635 cm. and the width about 3/16 in. (0.476). This tapering allows the face to be wider for a given amount of head mass. The face is about 1½ in. (3.81 cm.) from the center line of handle rod 12, which provides compactness and easier manipulation.

Figure 3:
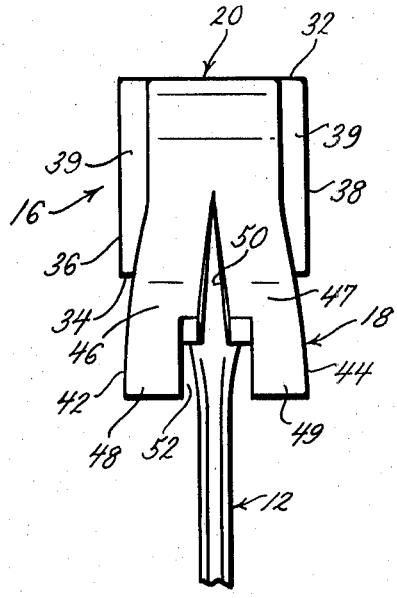
FIG. 3 is a rear plan view of the hammer looking from the right of FIG. 1 and showing the rectangular notch between the two claw fingers, the handle being shown broken.

The claw 18 curves rearwardly and downwardly from the intermediate portion 20, and as seen in FIG. 3, the outer edges 42 and 44 of the claw taper outwardly as they extend rearwardly. The claw spreads into two finger portions 46 and 47 which are separated first by a tapered V-shaped notch 50, which extends rearwardly into a right angular notch 52. The V notch 50 has a shown width of about 3/16 in. or 0.476 cm. so that it may be used to pull nails and the like, but it can be wider or smaller as desired. The notch 52 is about ⅜ in. (0.952 cm) wide and about ½ in. (1.27 cm) long, so that the prongs 48 and 49 formed at the finger ends between the notch 52 each have a width of about ⅜ in. (0.952 cm). The square notch 52 and prongs 48 and 49 are especially designed to allow the prongs to be conveniently inserted into and removed from loops of tie-wires used in concrete forms, such as the loop shown in FIG. 4.

The handle rod 12 has a tapered cross section at its upper portion ranging from a thickness about ⅛ to 3/16 inch (0.317 cm to 0.476 cm.), and tapers at its upper end into the intermediate portion 20. At its bottom end the handle tapers outwardly to form the gripping portion 14 which has a sufficient circumference to be grasped by a hand. The gripping portion 14 has an exterior rubber or plastic gripping surface 59 secured thereto as is known in the art, to prevent slipping of the hand. The handle is a type known in the art.

The hammer is made of a tough steel of the type which hammers used for driving nail or hard metal objects are composed. The weight of the hammer can vary depending on the material used and the length of the handle. A weight of about 20 oz. (566.99 gms.) has been found practical. The dimension of the hammer can vary according to the area within which it will be used, the size of the objects to be struck, and other factors which may suggest different dimensions. A length of 13½ in. (34.29 cm.) from top to bottom has been found practical. The tip of the claw prongs can extend to a point about 2⅜ in. (6.032 cm.) horizontally from the center line of the handle section. The metal hammer can be made of cast metal preferably, or it can be machined.

FIG. 5 shows the relevant portions of a modified head 16'. The face 22' has a recess shown in exaggerated form by dashed lines. This recess extends to the same depth as the maximum depth of the recess of FIG. 1, and the curvature of the recess can vary according to the desires of the user. The head 16' is otherwise the same as the head of FIG. 1. The flat recesses of FIGS. 1 and 2 are preferred because they have a greater tendency to direct the nail or other object stricken towards the center of the face.

In the case of a hammer having a circular face the recess can be a concave recess. However a square face is desired because it provides greater striking area, especially against an object that is either flush or close to another surface so that the object cannot be struck by the face center point.

OPERATION

In use the hammer can be gripped about the rubber surface 59 of the gripping portion 14 as would be done with a typical hammer. The hammer can be swung in the well known fashion to drive nails and other objects. The hammer may be aimed to have the center of the face 22 strike the nail head. However if one misses, and an off-center face portion strikes the nail head, the slanted surfaces 24, 26, 28 and 30 act to prevent the face 22 from sliding away from contact with the nail head.

Likewise the hammer can be used to drive staples, steel rods, and wedges. Its compact head enables it to be manipulated in close places, and allows greater control in swinging.

The hammer is particularly useful in labor involving concrete forms. Examples of forms used for forming concrete walls are shown in U.S. Pat. No. 3,241,802 to E. R. Lawrence, and U.S. Pat. No. 1,850,402 to L. Lampert, and said patents are herein incorporated by reference and made a part of this application. Other forms such as Symons forms and modular forms are well known in the art. In the said Lampert and Lawrence form structures, and in other concrete form structures well known in the art, there are wedges used to secure tie-rods or tie-wire to concrete forms to hold the forms in position for setting poured concrete. The said Lawrence patent shows use of wedges 31 having an L shape, while the said Lampert Patent shows vertically extending wedges 8.

With reference now to the said Lampert Patent it can be seen that the wedges 8 extend through the slot 7 in the bolts 5. The wedge 8 is adjacent the outer edge of a batten 3. The present hammer can be used to swing from the underside to strike the smaller end of the wedge 8 to drive it outward. Since the present hammer has flat surfaces 32, 36 and 38 it can be swung upwardly from a position standing to either side of the wedge 8 or in front of it with the flat surface being able to move near the flat outer surface of the battens 3. There is no need to use a crowbar or other object to pry the bottom of the wedge away from the batten, so that the other hand is free to catch the wedge 8 when it is disengaged.

The hammer can be so used to drive both vertically and horizontally extending wedges from concrete forms.

The hammer can be used to strike the underside of the wedges 31 in the said Lawrence patent. It can be seen in the said Lawrence patent that the bottoms of the wedges 31 can be close to other parts used with the forms.

Figure 6:
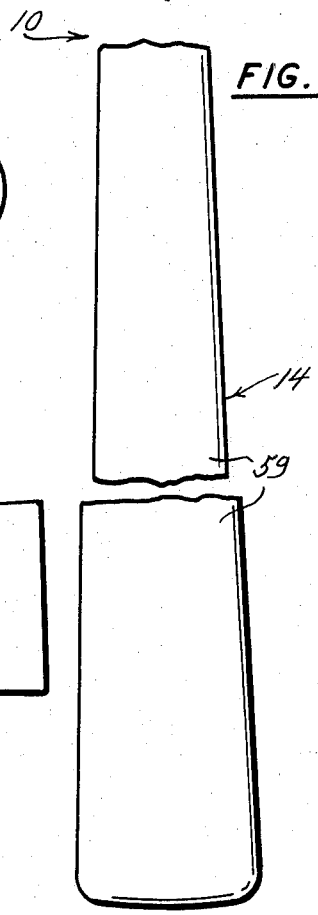
FIG. 6 is a top plan view of one of the types of pins which is used with concrete forms, which can be struck by the hammers, the top and bottom of the pin being flat.
Figure 6:
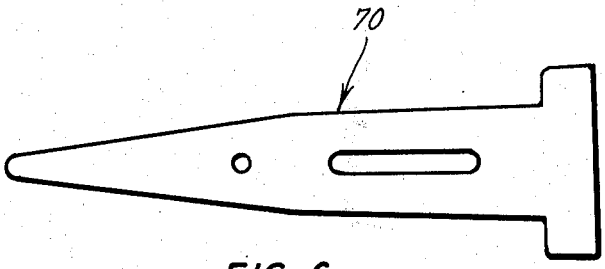

FIG. 6 shows a flat pin 70 used in Symons or modular types of concrete forms. The flat underside of the pin 70 can be positioned flush against the side of an angle iron when used in securing concrete forms. The present hammer, with its recessed face and flat head sides, can make swinging contact with the tip of the pin 70 to slide it along the flush side of an angle iron to disengage the pin from its attachment. No crowbar is necessary to pry the pin 70 outward from the angle iron, for striking by a hammer, and this keeps the other hand free to grab the pin.

Figure 4:
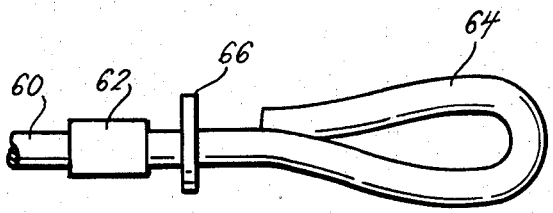
FIG. 4 shows a top plan view of a portion of a common snap tie used with building forms for concrete walls.

Shown in FIG. 4 is a portion of one end of a snap tie with a loop. The FIG. 4 snap tie has a wire section 60 which extends through concrete (not shown) when the snap tie is used with a concrete form, as is well known in the art. A crimped portion 62 is weaker than the rest of the snap tie, and the loop 64 is formed at the outer end, with a circular flange 66 to its left. In use with this type of snaptie, a wedge can be driven from out of the loop 64 by the present hammer and then either of the finger prong 48 or 49 of the claw can be inserted within the loop 64. The hammer can then be turned to twist the loop to break the weakened portion 62. The use of the notched prongs 48 and 49 rather than the claw fingers of a standard hammer, allow the hammer fingers to be quickly disengaged from the loop 64 without wedging between the claw fingers.

Referring again to the said Lampert patent the present prongs 48 and 49 can fit in the Lampert slot 7 to turn the bolts 5 without the use of a wrench to turn the Lampert bolt head 9, when the distance from the end of the Lampert bolt to the slot 7 is shorter than the width of the present notch 52. Thus since the prongs 48 and 49 are sufficiently spaced from each other, either one of the prongs 48 or 49 can be inserted in the Lampert slot to turn the bolt.

Variations of the embodiment shown will be apparent to those skilled in the art.

With regard to the embodiment shown, the notch 50 can also have a maximum width of 5/16 in. (0.794 cm.) to accomodate larger size nails. If the notch 50 is made wider, then the notch 52 can be also widened so that it is wide enough to prevent wedging of a tie-wire loop or the like. If the notch 52 is widened, then the prongs 48 and 49 can also be widened if desired, so that the rear width of the claw from side to side is increased.

With regard to the FIG. 5 modification of the recess, although the view is a side view, such as that of FIG. 1, a plan view from the top of the modified recessed head would appear the same as FIG. 5. The nature of the curve can vary, but in the curved modification, the face should curve inward from all four edges of the square face.

The inner edges of notch 52 preferably intersect the outer ends of the edges of the notch 50 at an angle near 90°, and an intersection angle of from about 75° to 90° is preferred. This allows the inner edges of the notch 52 to catch part of the tie-wire loop 64 to prevent it from wedging into the notch 50.

There are various changes and modifications which may be made to applicant's invention as would be apparent to those skilled in the art. However, any of the changes or modifications are included in the teaching of applicant's disclosure and he intends that his invention be limited only by the scope of the claims appended hereto.

I claim:

1. A hammer comprising:

(a) a grippable handle, (b) a head connected to the handle; and (c) the head having a front striking face recessed into the head, the recess having a plurality of inwardly inclined substantially flat surfaces.

2. The structure of claim 1 wherein the face is square, and the recess is formed by four substantially flat triangular shaped surfaces.

3. The structure of claim 1 wherein the head has exterior side surfaces which are substantially flat.

4. The structure of claim 1 wherein the face is about one and one half inches from the center line of the handle of the hammer, the face being square, the square being about one and one fourth inches to the side, and wherein the length of the hammer is about thirteen and one-half inches.

5. A hammer comprising: a grippable handle, a head connected to the handle, the head having a square striking face, the face being recessed into the head and having four inwardly slanting substantially flat surfaces each in the shape of an isosceles triangle.

6. A hammer comprising: a grippable handle, a head attached to the handle, the head having a face portion and a striking face on the face portion, a claw portion projecting from the head on the side of the handle opposite the face portion, and an intermediate portion between the face portion and the claw portion, the face portion being enlarged to be of greater width than the intermediate portion, and the depth of the enlarged face portion being from about one-half to two-thirds the distance from the face to the center axis of the handle, the face portion having a square cross-section and the face being recessed into the face portion, the recess having four inwardly inclined substantially flat surfaces each in the shape of an isosceles triangle slanting inwardly from the outer edges of the face, and wherein the claw is divided into two claw portions separated by a tapered notch, the outer ends of the claw portions being relieved adjacent to the tapered notch to form a relieved rectangular space, the claw portions adjacent the space forming means to receive and catch a snap tie loop, the rear edge of the relieved portion on each claw portion forming means to prevent entry of a snap tie loop into the tapered notch.

7. The hammer of claim 6 wherein a rear edge on a relieved portion of a claw portion intersects an edge of the tapered notch at an angle of from about 75 to about 90 degrees.

* * * * *